US009831055B2

(12) United States Patent
Beckert et al.

(10) Patent No.: US 9,831,055 B2
(45) Date of Patent: Nov. 28, 2017

(54) SURFACE MOUNT ELECTRICAL FUSE WITH A SUPPORT BRIDGE

(71) Applicant: LITTELFUSE, INC., Chicago, IL (US)

(72) Inventors: James J. Beckert, Rolling Meadows, IL (US); Gregory G. Stumpo, Schaumburg, IL (US); Andrew J. Saarnio, West Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 255 days.

(21) Appl. No.: 14/514,444

(22) Filed: Oct. 15, 2014

(65) Prior Publication Data

US 2016/0111240 A1 Apr. 21, 2016

(51) Int. Cl.

| | |
|---|---|
| ***H01H 85/50*** | (2006.01) |
| ***H01H 69/02*** | (2006.01) |
| ***H01H 85/08*** | (2006.01) |
| *H01H 85/00* | (2006.01) |
| *H01H 85/175* | (2006.01) |
| *H01H 85/041* | (2006.01) |

(52) U.S. Cl.

CPC ..... *H01H 69/02* (2013.01); *H01H 85/08* (2013.01); *H01H 85/0017* (2013.01); *H01H 85/175* (2013.01); *H01H 2085/0414* (2013.01)

(58) Field of Classification Search

CPC .... H01H 69/02; H01H 85/08; H01H 85/0017; H01H 85/175; H01H 2085/0414; H01H 2085/207; H01H 2085/208; H01H 2085/209; H01H 85/0026; H01H 2085/2055; H01H 85/204; H01H 1/42; H01H 85/153; H01H 85/0456; H01H 85/045

USPC ... 337/187, 9, 271, 268, 255, 254, 253, 252, 337/251, 198; 29/623

See application file for complete search history.

(56) References Cited

U.S. PATENT DOCUMENTS

| | | | | | |
|---|---|---|---|---|---|
| 4,635,023 | A * | 1/1987 | Oh | H01H 85/055 | 337/163 |
| 4,831,353 | A * | 5/1989 | Gaia | H01H 85/0417 | 29/623 |
| 4,894,633 | A * | 1/1990 | Holtfreter | H01H 85/0411 | 337/201 |
| 5,229,739 | A * | 7/1993 | Oh | H01H 69/02 | 337/255 |
| 5,977,860 | A * | 11/1999 | Ulm, Jr. | H01H 69/022 | 337/227 |
| 6,067,004 | A * | 5/2000 | Hibayashi | H01H 85/044 | 337/186 |
| 6,496,096 | B2 * | 12/2002 | Kondo | H01H 85/0417 | 337/231 |
| 6,577,222 | B1 * | 6/2003 | Krueger | H01H 85/17 | 337/180 |
| 6,734,780 | B2 * | 5/2004 | Endo | H01H 85/0417 | 337/231 |

* cited by examiner

*Primary Examiner* — Jerry Wu
*Assistant Examiner* — Stephen Sul

(57) ABSTRACT

An improved surface mount electrical fuse including a first fuse terminal; a second fuse terminal spaced apart from the first fuse terminal; and a fuse element formed from a conductive material, the fuse element having a support bridge for supporting the fuse element, the fuse element electrically connecting the first fuse terminal and the second fuse terminal.

11 Claims, 5 Drawing Sheets

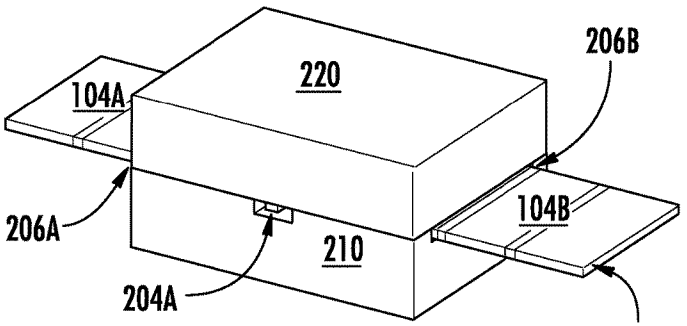
FIG. 2A
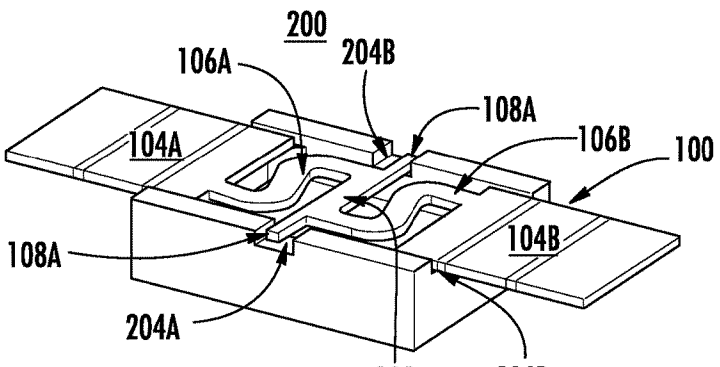
FIG. 2B
FIG. 2C
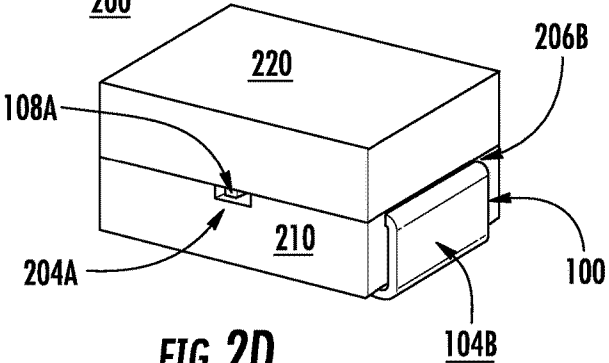
FIG. 2D

SURFACE MOUNT ELECTRICAL FUSE WITH A SUPPORT BRIDGE

FIELD OF THE DISCLOSURE

The disclosure relates generally to the field of circuit protection devices and more particularly to a surface mount device (SMD) electrical fuse with a support bridge.

BACKGROUND OF THE DISCLOSURE

Fuses are used as circuit protection devices and form an electrical connection between a power source and a component in a circuit to be protected. In particular, a fuse may be configured to protect against damage caused by an overcurrent condition. The fuse is constructed to physically open or interrupt a circuit path and isolate electrical components from damage upon the occurrence of specified overcurrent conditions in the circuit. Upon the occurrence of a specified fault condition, such as an overcurrent condition, the fusible element melts or otherwise opens to interrupt the circuit path and isolate the protected electrical components or circuit from potential damage. Such fusible elements are inherently fragile and may be prone to sagging, bending, or unintentional breaking during normal operations. If the structural integrity of the fuse, or more particularly the fuse element, is compromised at any point during normal operations, the fuse will be unable to function properly for opening or interrupting a circuit path or isolating electrical components from damage upon the occurrence of specified overcurrent conditions in the circuit. Thus, a need exists for a fuse having a fuse element with a support bridge for preventing sagging or bending of the fuse element during normal operations. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a fuse having a first fuse terminal, a second fuse terminal spaced apart from the first fuse terminal, and a fuse element formed from a conductive material. The fuse element includes a support bridge for supporting the fuse element. The fuse element electrically connects the first fuse terminal and the second fuse terminal. Other embodiments of the fuse are described and claimed herein.

Various embodiments are generally directed to a surface mount electrical fuse including a first fuse terminal, a second fuse terminal spaced apart from the first fuse terminal; and a fuse element forming a repeating pattern shape and formed from a conductive material, the fuse element having a support bridge for supporting the fuse element and the support bridge electrically connected and disposed coplanar between a first series of the repeating pattern shape and a second series of the repeating pattern shape, the fuse element electrically connecting the first fuse terminal and the second fuse terminal, and the support bridge maintaining the first series of the repeating pattern shape and the second series of the repeating pattern shape in the coplanar disposition.

A method for forming a fuse in accordance with the present disclosure may include the steps of providing a first insulative housing unit having a base section and a top section, wherein the base section is configured with side notches at respective sides of the first insulative housing unit and end apertures at respective ends of the first insulative housing unit, providing a first fuse terminal, providing a second fuse terminal spaced apart from the first fuse terminal, providing a fuse element formed from a conductive material, the fuse element having a support bridge for supporting the fuse element, the fuse element electrically connecting the first fuse terminal and the second fuse terminal and the support bridge being formed from the conductive material, and connecting the fuse element in a cavity of the first insulative housing unit with the first fuse terminal and the second fuse terminal extending beyond the end apertures, and ends of the support bridge disposed on the side notches.

BRIEF DESCRIPTION OF THE DRAWINGS

By way of example, specific embodiments of the disclosed device will now be described, with reference to the accompanying drawings, in which:

FIG. 2A illustrates a perspective view of a housing unit embodiment in accordance with the present disclosure.

FIG. 2B illustrates a perspective view of a base section of the housing unit embodiment housing the exemplary fuse in FIG. 1.

FIG. 2C illustrates a perspective view of a base section and a top section of the housing unit embodiment housing the exemplary fuse in FIG. 1.

FIG. 2D illustrates a perspective view of an assembled housing unit embodiment housing the exemplary fuse in FIG. 1.

DETAILED DESCRIPTION

Figure 1:
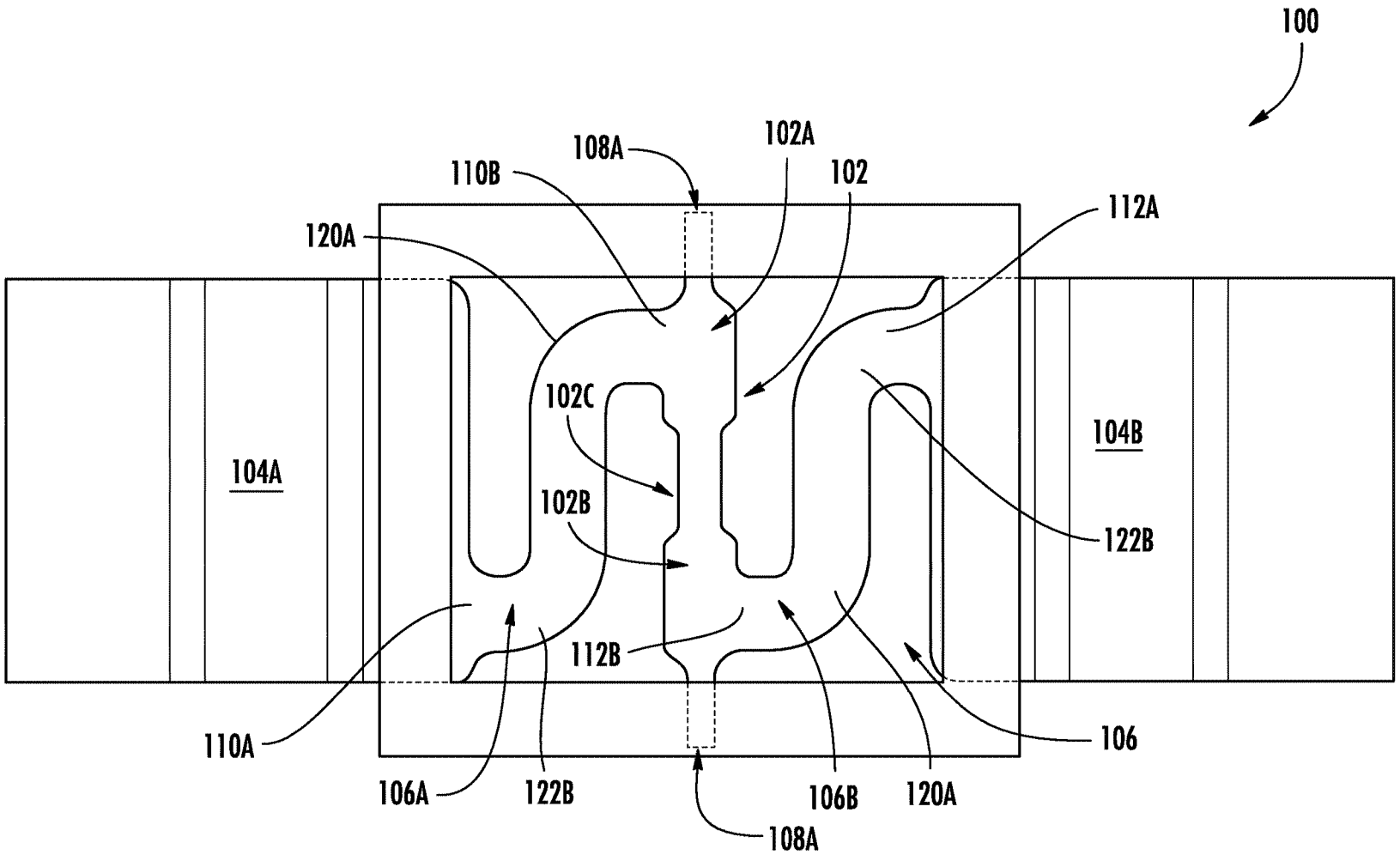
FIG. 1 illustrates a perspective exploded view of an exemplary fuse in accordance with the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 illustrates a perspective exploded view of an exemplary fuse 100 in accordance with the present disclosure. The fuse 100, such as, for example, a surface mount device (SMD) electrical fuse, includes a fuse element 106, a support bridge 102, a first fuse terminal 104A and a second fuse terminal 104B. The second fuse terminal 104B is spaced apart from the first fuse terminal 104A. A fuse element 106 electrically connects the first fuse terminal 104A and the second fuse terminal 104B.

The fuse element 106, support bridge 102, the first fuse terminal 104A and/or the second fuse terminal 104B may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. The conductive materials may be decided based on fusing characteristic and durability. The fuse 100 may be rated for any desirable amperage. For example, an SMD autofuse may be fuse 100 and may be rated for 1 amp to 80 amps. For uses other than SMD autofuses, fuse 100 and fuse element 106 may have different amperage ratings as desired.

The fuse 100 may comprise a plate type substance and at least a portion thereof is bent to absorb the thermal expansion and contraction of the fuse element 106. An insulative body is fitted over the fuse element 106 and over at least substantially all of the first fuse terminal 104A and the second fuse terminal 104B.

The fuse element 106 electrically connects the first fuse terminal 104A and the second fuse terminal 104B. In one embodiment, the fuse element 106 forms a first end 110A and a second end 110B, the first end 110A and the second end 110B having an S shape. In one embodiment, the fuse element 106 forms an additional first end 112A and an additional second end 112B. The first end 110A and the second end 110B having an S shape. The additional first end 112A and the additional second end 112B having an S shape. The support bridge 102 electrically connects the first end 110A and the second end 110B. The support bridge 102 also electrically connects the additional first end 112A and the additional second end 112B.

Also, the fuse element 106 forms a repeating pattern shape, such as the first series of repeating pattern shapes 106A and the second series of repeating pattern shapes 106B. The support bridge 102 is coplanar with the first end 110A, such as a first series of repeating pattern shapes 106A of the first end 110A, and the second end 110B, such as a second series of repeating pattern shapes 106B of the second end 110B. The support bridge 102 is coplanar with the additional first end 112A, such as the first series of repeating pattern shapes 106A of the additional first end 112A, and the additional second end 112B, such as the second series of repeating pattern shapes 106B of the additional second end 112B. The support bridge 102 prevents the fuse element 106 from moving, sagging, and/or bending.

The fuse element 106 may be formed from a conductive material, such as, for example, formed from a conductive foil bonded to a surface of a substrate. The conductive foil covers the fuse element 106 in fuse 100. The fuse element 106 includes the support bridge 102 for supporting the fuse element 106. The support bridge 102 is electrically connected and disposed coplanar between a first series of repeating pattern shapes 106A and a second series of repeating pattern shapes 106B. The support bridge 102 may be an elongated conductive element interconnecting sections of the fuse element 106, such as, for example, electrically connecting, supporting, and preventing a bending of the first series of repeating pattern shapes 106A and the second series of repeating pattern shapes 106B. In one embodiment, more than one support bridge 102 may be electrically connected and disposed coplanar between the fuse element 106. For example, a support bridge 102 may be disposed coplanar after each repeating pattern shape for providing continual support of the fuse element 106 for preventing bending or sagging of the fuse element 106. In another embodiment, the support bridge 102 may be stacked on top of or positioned in a side-by-side arrangement with another support bridge 102. Each support bridge 102 may be electrically connected and disposed between the first series of repeating pattern shapes 106A and the second series of repeating pattern shapes 106B.

The support bridge 102 maintains and ensures that the first series of repeating pattern shapes 106A and the second series of repeating pattern shapes 106B remain in the coplanar disposition. In other words, the support bridge 102 prevents the fuse element 106, or more specifically, the first series of repeating pattern shapes 106A and the second series of repeating pattern shapes 106B, from sagging, bending, adjusting, swaying, and/or moving.

To prevent the fuse element 106 from sagging, bending, adjusting, swaying, and/or moving, the first series of repeating pattern shapes 106A and the second series of repeating pattern shapes 106B may be positioned, aligned, or connected to one of a variety of locations on the support bridge 102. For example, the first series of repeating pattern shapes 106A may have a first end 110A connected to the first fuse terminal 104A and a second end 110B connected to one of a variety of locations on the support bridge 102. Similarly, the second series of repeating pattern shapes 106B may have a additional first end 112A connected to the second fuse terminal 104B and an additional second end 112B connected to one of a variety of locations on the support bridge 102. In one embodiment, the portions of the support bridge 102 connected to the first fuse terminal 104A and a second end 110B may be greater in width and length than non-connecting portions of the support bridge 102. For example, the support bridge 102 may have a first connection point 102A, a second connection point 102B and a middle portion 102C. The first connection point 102A and the second connection point 102B being equal in width and length. The middle portion 102C having a width that is less than the width of both the first connection point 102A and the second connection point 102B. However, the length of the middle portion 102C may be greater than, equal to, and/or smaller than both the first connection point 102A and the second connection point 102B. The first connection point 102A may be electrically connected to the second end 110B of the first series of repeating pattern shapes 106A. The second connection point 102B may be electrically connected to the additional second end 112B of the second series of repeating pattern shapes 106B. The support bridge 102 is disposed coplanar and placed in parallel with the first fuse terminal 104A and the second fuse terminal 104B. The connecting sections, such as first connection point 102A and the second connection point 102B, on the support bridge are positioned coplanar with the first series of repeating pattern shapes 106A and the second series of repeating pattern shapes 106B and the first fuse terminal 104A and the second fuse terminal 104B.

In one embodiment, the repeating pattern shape, such as the first series of repeating pattern shapes 106A and the second series of repeating pattern shapes 106B, of the fuse element 106, is a series of serpentine shaped windings. In an alternative embodiment, the first series of repeating pattern shapes 106A and the second series of repeating pattern shapes 106B are s-shaped repeating patterns.

More specifically, in one embodiment, the first series of repeating pattern shapes 106A is bent concavely describing a first arc 120A, such as a convex arc or concave arc, with a width almost equal to a width of the first fuse terminal 104A and is then bent convexly describing a second arc 122B, such as a convex arc or concave arc, with the same width as mentioned above. As the result, the fusing section is formed in a wave or "S" form. Similarly, the second series of repeating pattern shapes 106B is bent concavely describing the first arc 120A with a width almost equal to a width of the second fuse terminal 104B and is then bent convexly describing a second arc 122B with the same width as mentioned above. As the result, the fusing section is formed in a wave or "S" form.

Alternatively, the first series of repeating pattern shapes 106A may be formed straight toward the first fuse terminal 104A from the second end 110B connected to the support bridge 102 with the width narrower than that of the first fuse terminal 104A and equal to the width of the support bridge 102 and describing the first arc 120A partially against the first fuse terminal 104A and then describing the second arc 122B partially against the support bridge 102 to be connected to the first fuse terminal 104A by the first end 110A. Additionally, the second series of repeating pattern shapes 106B may be formed straight toward the second fuse terminal 104B from the additional second end 112B connected to the support bridge 102 with the width narrower than that of the second fuse terminal 104B and equal to the width of the support bridge 102 and describing the first arc 120A partially against the second fuse terminal 104B and then describing the second arc 122B partially against the support bridge 102 to be connected to the second fuse terminal 104B by the first end 112A. As the result, the fuse element is formed substantially in an S-shaped form. It should be noted that the first series of repeating pattern shapes 106A and the second series of repeating pattern shapes 106B may also be defined in one of a plurality of alternative patterns.

The supporting bridge 102 extends respectively across the first series of repeating pattern shapes 106A and the second series of repeating pattern shapes 106B. More specifically, the support bridge 102 centrally located between and coplanar and in parallel with the first fuse terminal 104A and the second fuse terminal 104B. As such, the support bridge supports and prevents sagging or bending of the first series of repeating pattern shapes 106A and the second series of repeating pattern shapes 106B. Also, the support bridge 102 includes supporting sections 108A extending respectively on the support bridge 102 away from second end 110B of the first end 110A and away from additional second end 112B of the second end 110B. The support sections 108A may have a width and length equal to each other and may be may be greater than, equal to, and/or smaller than both the first connection point 102A and the second connection point 102B or the middle portion 102C.

The second end 110B of the first series of repeating pattern shapes 106A and the additional second end 112B of the second series of repeating pattern shapes 106B are longitudinally spaced apart from one another a distance by a predetermined amount or by manufactured preferences. In one embodiment, the fuse element 106 and the support bridge 102 are two separate components soldered together. In an alternative embodiment, the fuse element 106 and the support bridge 102 are designed as one continuous conductive material, and stamped together using a conventional stamping process that will be familiar to those of ordinary skill in the art. For example, a sheet of material may be used for stamping the fuse element 106 and the support bridge 102 and may have a thickness that facilitates conventional stamping of the material. In some examples, sheet of material may have a thickness of about 0.75 mm.

FIGS. 2A-2D illustrate the fuse 100 being housed within a housing unit 200. FIG. 2A illustrates a perspective view of a housing unit 200 in accordance with the present disclosure. FIG. 2A depicts the housing unit 200 in a disassembled configuration. FIG. 2B illustrates a perspective view of a base section of the housing unit 200 housing the exemplary fuse in FIG. 1. The housing unit 200 houses the fuse 100. The housing unit 200 includes a base section 210 and a top section 220 with the fuse element 106 being bonded or connected between the base section 210 and the top section 220. When the base section 210 and the top section 220 are aligned with one another, a cavity 225, such as, for example, a central air gap or chamber, is formed within the fuse 100. The cavity 225 is partially formed within both the base section 210 and the top section 220, which may be filled with an insulative material. The base section 210 and/or the top section 220 are configured with receiving notches 204B, such as side receiving notches, for receiving the supporting sections 108A of the support bridge 102. The housing unit 200 is configured with a first aperture 206A and a second aperture 206B. The first fuse terminal 104A extends through the first aperture 206 and the second fuse terminal 104B extends through the second aperture 206B. Thus, the fuse element 106 connects the first fuse terminal 104A to the second fuse terminal 104B and provides an electrically conductive pathway therebetween, and a portion of the fuse element passes through the cavity 225.

FIG. 2C illustrates a perspective view of a base section 210 and a top section 220 of the housing unit 200 and fuse 100 and FIG. 2D illustrates a perspective view of an assembled housing unit 200 housing the fuse 100. The first fuse terminal 104A extends through the first aperture 206A and the second fuse terminal 104B extends through the second aperture 206B. The first fuse terminal 104A and the second fuse terminal 104B wrapping around the base section 210 of the housing unit 200. When fully assembled, the base section 210 and the top section 220 use the receiving notches 204B for receiving and supporting the supporting sections 108A of the support bridge 102.

Figure 3A:
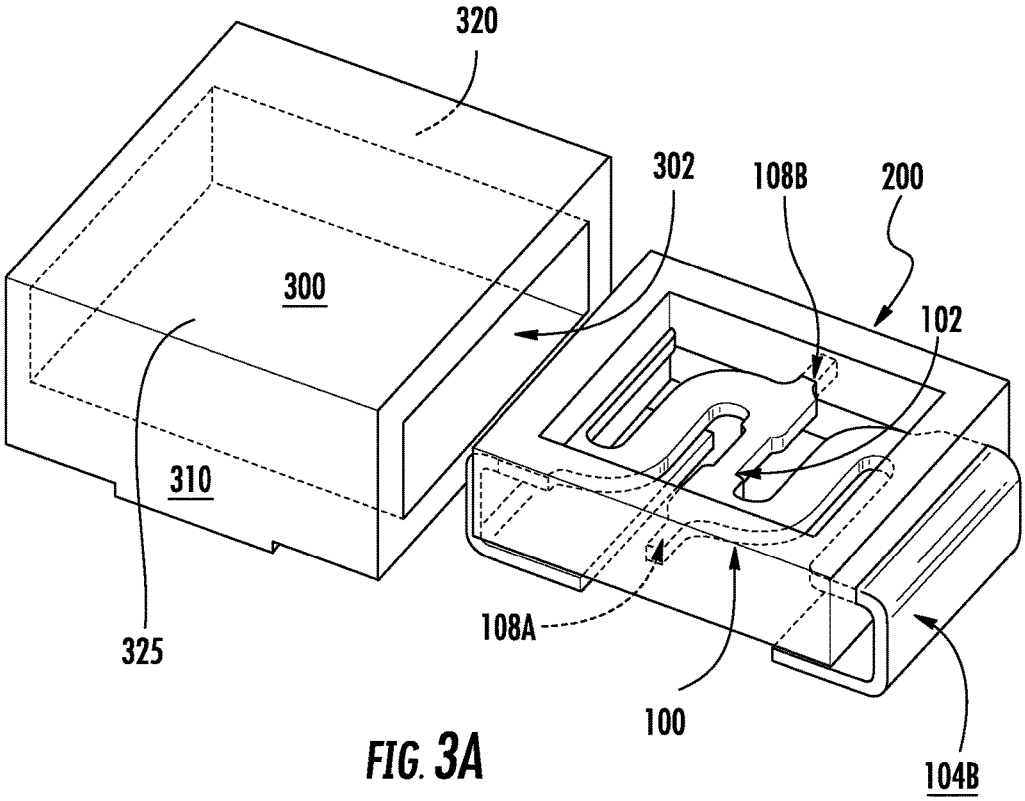
FIGS. 3A-3B illustrate a perspective view of another alternative housing unit embodiment housing both the housing unit embodiment of FIG. 2A and the exemplary fuse in FIG. 1.
Figure 3B:
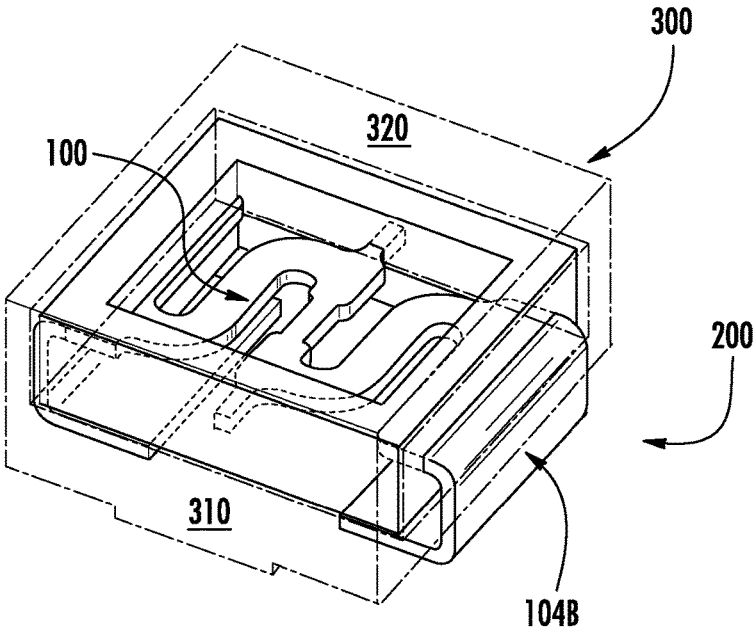

FIGS. 3A-3B illustrate a perspective view of another alternative housing unit 300 housing both the housing unit 200 and the fuse 100. FIG. 3A depicts the housing unit 200 disassembled configuration from a second housing unit 300. FIG. 3B depicts the housing unit 200 in an assembled configuration from a second housing unit 300. In one embodiment, a second housing unit 300 may be used for housing the housing unit 200, which houses the fuse 100. The housing unit 200 includes a base section 310 and a top section 320. In one embodiment, the second housing unit 300 is one non-separated housing device.

A cavity 325 is formed within both the base section 310 and the top section 320, which may be filled with an insulative material. The second housing unit 300 includes a central aperture 302 for receiving the housing unit 200. The housing unit 200 is bonded within the second housing unit 300. In one embodiment, the housing unit 200 is placed first onto the base section 310 of the second housing unit 300. The top section 320 is then bonded over the housing unit 200 onto the base section 310. In an alternative embodiment, the housing unit 200 is positioned within the second housing unit 300 using the central aperture 302. The housing unit 200 configured to be urged and manipulated through the central aperture 302 into the second housing unit 300. The first fuse terminal 104A and the second fuse terminal 104B may be wrapped around the base section 210 of the housing unit 200 or wrapped around the base section 310 of the second housing unit 300. Thus, the second housing unit 300 having the central aperture 302 defined therein is configured for housing the housing unit 200. The housing unit 200 is configured for housing the fuse 100 having the support bridge 102.

Figure 4:
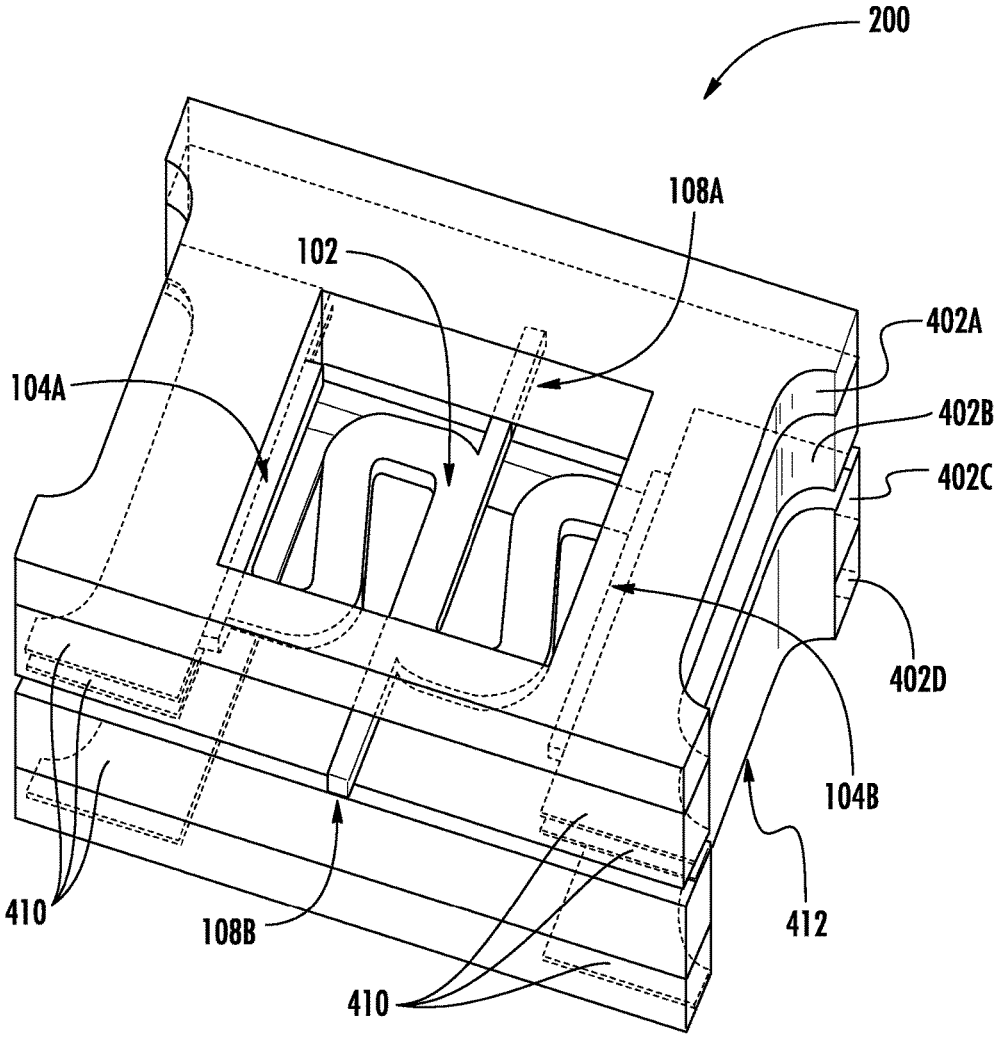
FIG. 4 illustrates a perspective 3D-view of a housing unit embodiment in accordance with the present disclosure.

FIG. 4 illustrates a perspective 3D-view of a housing unit having multiple layers in accordance with the present disclosure. In one embodiment, the housing unit 200 may be formed using a plurality of layers, such as four layers, and disposed in a vertically stacked configuration. The number of layers may be altered based on characteristic and durability of the fuse 100. The layers may be insulative layers formed of any suitable electrically insulative material, including, but not limited to, FR-4, glass, ceramic, plastic, etc.

The housing unit 200 includes a first layer 402A, a second layer 402B, a third layer 402C, and fourth layer 402D. The first layer 402A and the second layer 402B may form the top section 220 of the housing unit 200. The third layer 402C and the fourth layer 402D may form the base section 210 of the housing unit 200. The first layer 402A, the second layer 402B, the third layer 402C, and the fourth layer 402D may be sheets of material, such as, for example FR4, or other suitable non-conductive material or other material, using a conventional stamping or milling process that will be familiar to those of ordinary skill in the art. Also, the plurality of layers may be stamped out of a sheet of material, such as, for example FR4, or other suitable non-conductive material or other material, using a conventional stamping process that will be familiar to those of ordinary skill in the art.

When assembled as shown in FIG. 4, the first layer 402A, the second layer 402B, the third layer 402C, and the fourth layer 402D may be flatly bonded to each other, such as with epoxy or other non-conductive adhesives or fasteners. The first layer 402A, the second layer 402B, the third layer 402C, and the fourth layer 402D may be substantially rectangular.

The first layer 402A, the second layer 402B, the third layer 402C, and the fourth layer 402D may be bonded together using an adhesive, such as, for example, "prepreg" or other appropriate bonding agent. In some examples, first layer 402A, the second layer 402B, the third layer 402C, and the fourth layer 402D may be bonded, laminated, or otherwise affixed to each other using any suitable process or technique. More specifically, the first layer 402A may be bonded on upper and/lower surfaces of the second layer 402B adjacent to a first lateral edge of both the second layer 402B and the first layer 402A. Similarly, the third layer 402C may be bonded on upper and/lower surfaces of the fourth layer 402D adjacent to a first lateral edge of both the second layer 402B and the fourth layer 402D. Also, the housing unit 200 includes several laminations 410 housed between the layers.

The housing unit 200 includes the fuse 100 disposed intermediate the second layer 402B and the third layer 402C within the cavity 225 (FIG. 1). When the housing unit 200 is assembled, the cavity 225, such as an air gap, of the housing unit 200 allows for the fuse element 106 to extend through the cavity 225 defined by the base section 210 of the housing unit 200 assembled with the top section 220 of the housing unit 200. The central portion of the fuse element 106 is therefore entirely surrounded by air within the housing unit 200, which thereby increases the breaking capacity of the fuse 100. An insulative adhesive may be applied to an interior surface, such as the interior edges of the housing unit 200 and seals the cavity 225. As will be appreciated by those of ordinary skill in the art, the particular size, configuration, and conductive material of the fuse element 106 may all contribute to the rating of the fuse 100.

Figure 5:
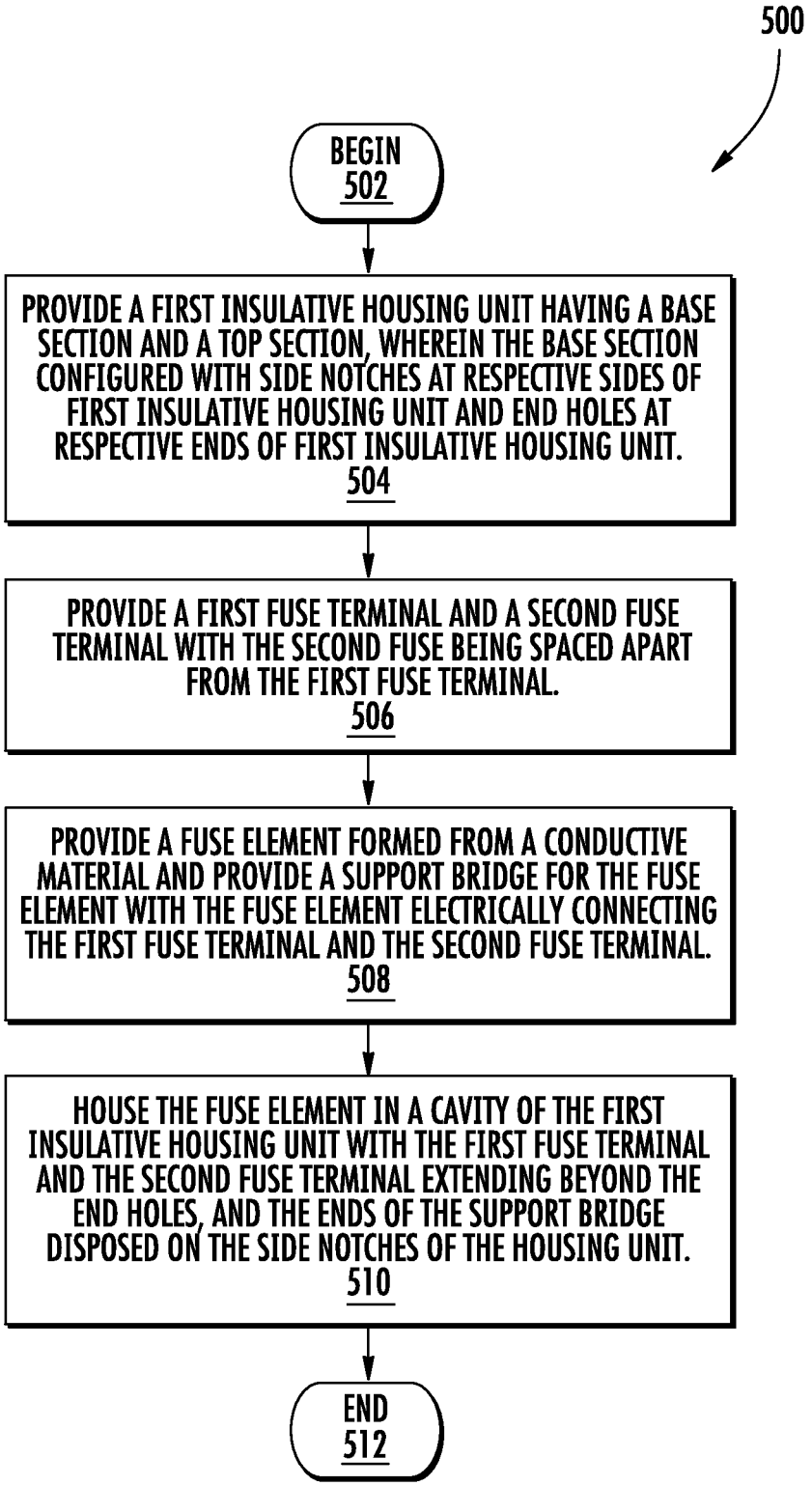
FIG. 5 illustrates a logic flow diagram in connection with the fuse shown in FIG. 1.

FIG. 5 illustrates a logic flow diagram 500 in connection with the fuse shown in FIG. 1. FIG. 5 is a flow chart illustrating a method 500 for providing a surface mount electrical fuse, arranged in accordance with at least some embodiments of the present disclosure. In general, the method 500 is described with reference to FIGS. 1-4. It is to be appreciated, that the method 500 may also be used to manufacture the fuse 100 described or other fuses consistent with the present disclosure. The method 500 may begin at block 502. At block 504, a housing unit, such as a first insulative housing unit, having a base section and a top section is provided, and the base section is configured with side notches at respective sides of housing unit and end apertures, apertures, or cutouts, at respective ends of housing unit. At block 506, a first fuse terminal and a second fuse terminal is provided and the second fuse terminal spaced apart from the first fuse terminal. A fuse element is provided, at block 508, from a conductive material, such as, for example, conductive foil bonded to a surface of a substrate, and the fuse element includes a support bridge for supporting the fuse element. The fuse element electrically connects the first fuse terminal and the second fuse terminal. At block 510, the fuse element is housed in a cavity of the housing unit with the first fuse terminal and the second fuse terminal extending beyond the end apertures, and ends of the support bridge disposed on the side notches. The cavity may be filled with an insulative material surrounding the fuse element of the fuse and the support bridge. The method 500 ends at block 512.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

The invention claimed is:

1. A fuse comprising:

a fuse element;

a first fuse terminal connected to the fuse element at a first connection point and extending from the fuse element in a first direction; and a second fuse terminal connected to the fuse element at a second connection point and extending from the fuse element in a second direction opposite the first direction;

the fuse element including a support bridge having flanged supporting sections extending in opposite directions from the first and second connection points, respectively, along an axis oriented transverse to the first direction and to the second direction, the flanged supporting sections adapted to engage an adjacent structure to restrict flexure of the fuse element;

wherein the first and second connection points have widths that are greater than widths of the flanged supporting sections and that are greater than a width of a middle portion of the support bridge extending between the first and second connection points.

2. The fuse according to claim 1, the fuse element defining a first serpentine-shaped portion connecting the support bridge to the first fuse terminal and defining a second serpentine-shaped portion connecting the support bridge to the second fuse terminal.

3. The fuse according to claim 2, wherein the support bridge is coplanar with the first serpentine-shaped portion and the second serpentine-shaped portion.

4. The fuse according to claim 1, further comprising an insulative housing unit for housing the fuse element, the housing unit having a base section and a top section with the fuse element disposed between the base section and the top section, wherein the base section includes receiving notches for receiving the flanged supporting sections of the support bridge to restrict movement of the fuse element.

5. The fuse according to claim 4, wherein the insulative housing unit includes a first aperture and a second aperture, wherein the first fuse terminal extends through the first aperture and the second fuse terminal extends through the second aperture.

6. The fuse according to claim 5, further comprising a second insulative housing unit for housing the first insulative housing unit, the second insulative housing unit having a central aperture for receiving the first insulative housing unit, wherein the first insulative housing unit is bonded within the second insulative housing unit.

7. The fuse according to claim 6, wherein the first fuse terminal and the second fuse terminal wrap around the base section of the first insulative housing unit.

8. The fuse according to claim 7, wherein the first fuse terminal and the second fuse terminal wrap around the second insulative housing unit.

9. A method for forming a surface mount electrical fuse comprising:

providing an insulative housing unit having a base section and a top section, wherein the base section includes notches formed in opposing sides thereof;

providing a fuse element disposed within the insulative housing;

providing a first fuse terminal connected to the fuse element at a first connection point and extending from the fuse element in a first direction;

providing a second fuse terminal connected to the fuse element at a second connection point and extending from the fuse element in a second direction opposite the first direction;

the fuse element including a support bridge having flanged supporting sections extending in opposite directions from the first and second connection points, respectively, along an axis oriented transverse to the first direction and to the second direction, wherein the flanged supporting sections are disposed within the notches for restricting flexure of the fuse element; and wherein the first and second connection points have widths that are greater than widths of the flanged supporting sections and that are greater than a width of a middle portion of the support bridge extending between the first and second connection points.

10. The method of claim 9, further forming a second insulative housing unit for housing the first insulative housing unit, the second insulative housing unit having a central aperture for receiving the first insulative housing unit, wherein the first insulative housing unit is bonded within the second insulative housing unit.

11. The method of claim 10, wherein the first fuse terminal and the second fuse terminal wrap around the base section of the first insulative housing unit or alternatively wrap around the second insulative housing unit, wherein an insulative adhesive is applied to an interior surface of the first housing unit and seals the cavity.

* * * * *